US005503289A

United States Patent [19]

Fox

[11] Patent Number: 5,503,289

[45] Date of Patent: Apr. 2, 1996

[54] BEVERAGE CONTAINER LID HAVING A RETAINABLY OPENED ACCESS FLAP

[76] Inventor: Robert M. Fox, 897 S. Dwyer Ave., Arlington Height, Ill. 60005

[21] Appl. No.: 915,125

[22] Filed: Jul. 17, 1992

[51] Int. Cl.[6] ..... B65D 51/18

[52] U.S. Cl. ..... 220/254; 220/265; 220/268; 220/269; 220/306; 220/335; 220/355; 220/356; 220/713; 220/712

[58] Field of Search ..... 220/712, 703, 220/711, 713, 254, 265, 268, 269, 306, 335, 355, 356

[56] References Cited

U.S. PATENT DOCUMENTS

| | | | |
|---|---|---|---|
| 3,994,411 | 11/1976 | Elfelt et al. . | |
| 4,202,459 | 5/1980 | De Parales et al. | 220/712 |
| 4,253,582 | 3/1981 | Shields | 220/269 |
| 4,322,015 | 3/1982 | Bailey . | |
| 4,438,865 | 3/1984 | Scattaregia . | |
| 4,460,103 | 7/1984 | Rama et al. | 220/254 |
| 4,473,167 | 9/1984 | Bailey . | |
| 4,502,608 | 3/1985 | Mills | 220/712 |
| 4,518,096 | 5/1985 | Winstead | 220/268 |
| 4,629,088 | 12/1986 | Durgin . | |
| 4,687,116 | 8/1987 | Dutt et al. . | |
| 4,738,373 | 4/1988 | Deparales . | |
| 4,741,450 | 3/1988 | Braude . | |
| 4,747,509 | 5/1988 | Florkiewicz et al. . | |
| 4,760,934 | 8/1988 | Netsch | 220/269 |
| 4,949,865 | 8/1990 | Turner | 220/713 |
| 5,062,542 | 11/1991 | Morton | 220/269 |
| 5,090,584 | 2/1992 | Roberts et al. | 220/712 |
| 5,111,961 | 5/1992 | Van Melle | 220/712 |

*Primary Examiner*—Allan N. Shoap
*Assistant Examiner*—Robin A. Hylton
*Attorney, Agent, or Firm*—James T. FitzGibbon

[57] ABSTRACT

A container lid adapted for removable reception over a rim portion of a associated container having a center panel portion and a peripheral skirt portion depending therefrom and having a small pin latch opening extending through the center panel portion and also including an access flap formed by portions of the center panel and the peripheral skirt adapted to provide access to the interior of the container.

7 Claims, 1 Drawing Sheet

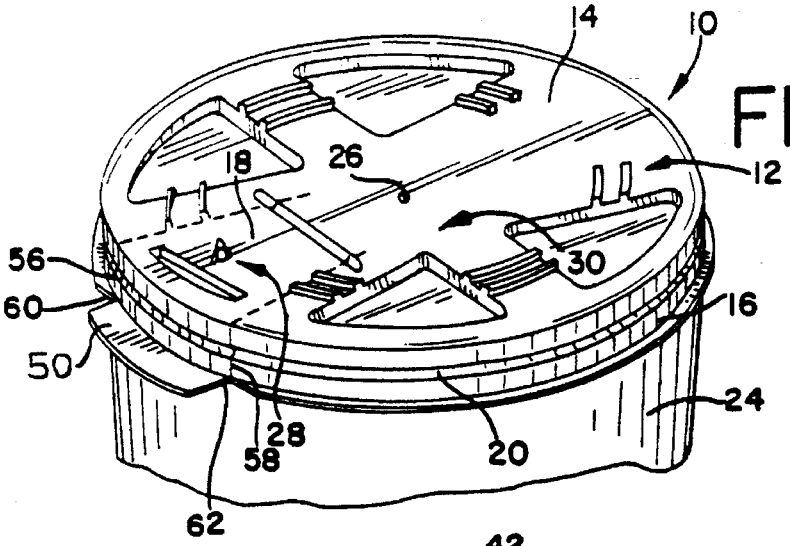
FIG. 1
FIG. 2A
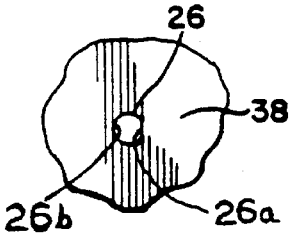
FIG. 2
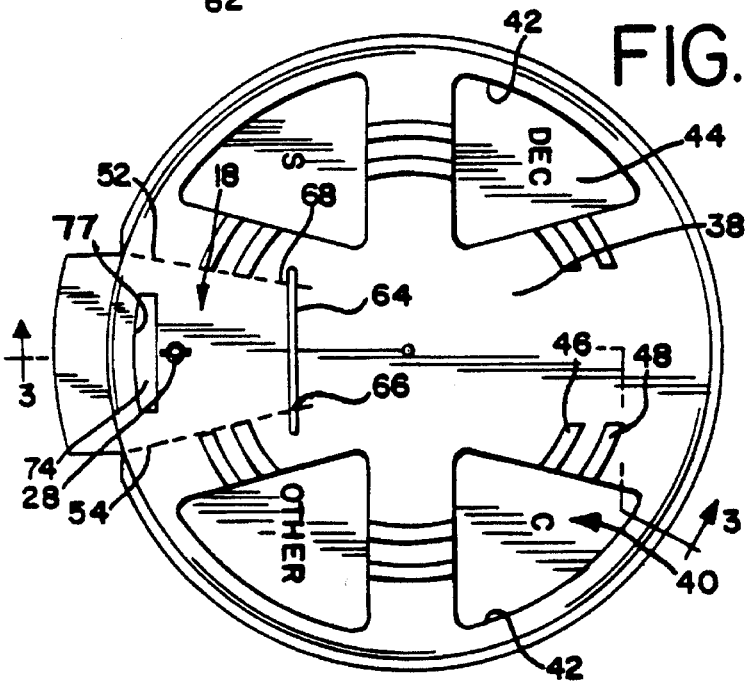
FIG. 5
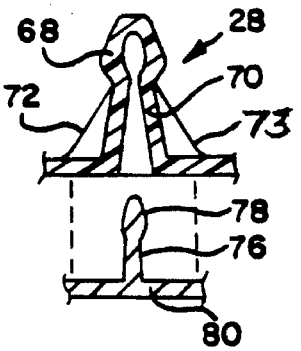
FIG. 3
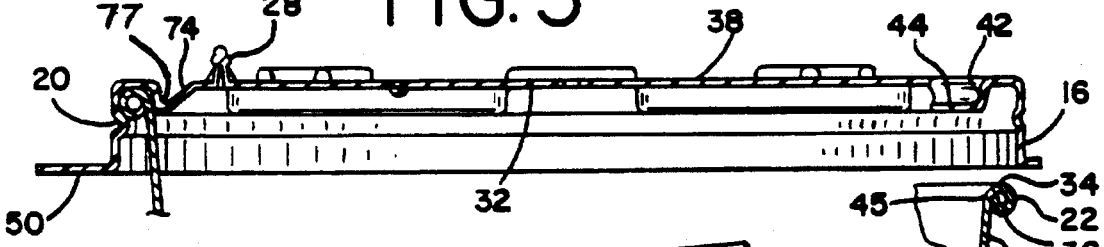
FIG. 4
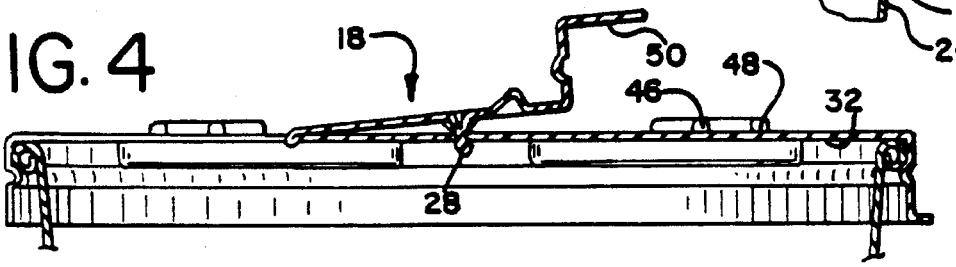

BEVERAGE CONTAINER LID HAVING A RETAINABLY OPENED ACCESS FLAP

BACKGROUND OF THE INVENTION

The present invention relates generally to container lids, and more particularly to container lids utilized in the food and beverage industry that allow access to the contents of the container.

With the ever increasing mobility of the population, it has become a common practice for retail outlets to dispense hot or cold beverages in throwaway containers usually of a type providing heat insulation; the contents of the containers are kept in place by the provision of removable lids. Generally, such lids are comprised of thin resilient polymeric material. The lids are removed to allow a full width opening for filling and then placed over the container to eliminate the problem of spilling the container contents. Such spillage may occur accidentally, such as by simple clumsiness on the part of the user, or by exposure to other causes, such as the result of a rough vehicle ride, the attempt by a user to walk or run, or otherwise. With a fully closed lid the purpose of preventing spilling, most users also desire to drink from the container without removing the lid entirely. This reduces the chances of spillage, especially where consumption occurs in a moving vehicle. A lid also provides thermal insulation. Therefore, various expedients have been provided to allow access without complete opening and/or removal of the cover.

Attempts in the past to overcome the problem of spillage have included providing an opening in the container lid to receive a straw. This type of lid is effective for use with those cold drinks that are conducive to consumption through a straw. However, hot drinks such as coffee, hot chocolate or tea, and cold drinks such as beer and ale are not amenable to consumption through a straw. Therefore, the lid on a container designed to eliminate spillage has sometimes required removal in order to drink the beverage. Removal of the lid increases the area through which the beverage may be spilled and exposes the beverage to ambient temperature conditions. This can foster relatively rapid and undesired temperature changes of the beverage, should the desired consumption temperature be hotter or colder than ambient.

Prior art attempts at solving this problem included a container lid having a small removable portion, limiting exposure of the beverage or drink to ambient conditions and reducing the area through which the beverage may spill while still allowing the user access to the contents of the container.

This was often accomplished by providing, in general, a pair of spaced apart tear impressions extending inwardly from the edge of the lid which terminated within the central portion of the lid and defined therebetween a portion sometimes herein referred to as an access strip. This access strip was usually recloseable, at least in theory, and usually included a self-forming foldline associated with a pair of spaced-apart tear impressions being used to define the entire access strip.

However, due to the resilient nature of the lid material, the recloseable access strip often interfered with the user's access to the beverage and oftentimes led to spillage on the individual user. Attempts at providing an access strip securable in both open and closed positions to allow a user to drink free from interference with the access strip have been made, but such attempts thus far have not always been successful.

The access strips associated with the prior art would sometimes not stay in their secured open position, often releasing from this position while the user was drinking. Additionally, significant manipulation was required on the part of the user to secure the access strip in the open position; this was also required to return the strip to its closed position to prevent further spillage. In other cases, formation of the parts needed to provide a two-position "bistable" access strip i.e., one that stays either open or closed, as desired, has been unduly complicated and/or expensive.

In accordance with the present invention, these problems have been substantially overcome.

In view of the failure of the prior art to provide a cover or lid with the best combination of advantageous features, it is a principal object of the present invention to provide an improved container lid.

Another object of the invention is to provide a container lid which allows direct access to the container contents while being readily reclosed so as to substantially reduce the rate of temperature change and also to avoid spillage of the contents.

Yet another object of the invention is to provide a container lid which may be moved from a substantially secure closed position to a substantially secure opened position with very limited manipulation on the part of the user.

Another object of the invention is to provide a container lid wherein an access flap is provided that, in combination with a portion of the lid, provides a pin latch mechanism for retaining the access flap in an open position.

Another object of the invention is to provide a container lid which be can be made as economically as prior art lids, but which also includes other desirable features of operation and construction.

A still further object of the invention is to provide a thermoplastic container lid which includes an access flap with a finger tab and wherein the access flap may be latched in the open position without positioning the finger tab in an inaccessible position.

Yet another object of the invention is to provide a container lid wherein the access flap portion thereof includes a pin latch mechanism which may be formed by an ingenious but simple and effective method.

A still further object of the invention is to provide a container lid which includes an improved, simple mechanism for retaining the lid in the open position and which permits considerable design flexibility in positioning the cooperative latching elements.

Yet another object of the invention is to provide a container lid having an access flap which may be latched in the open position and wherein the mechanism includes a pin which cooperates with an opening that also serves as a vent opening in the container lid.

Yet another object of the invention is to provide a container lid which is adapted for cooperation with a wide variety of cups or like containers.

The foregoing and other objects are achieved in practice by providing a lid having a center panel, a peripheral skirt, lines of weakness defining an access flap, and a latch pin mechanism for removably positioning the flap in a latched-open position.

The exact manner in which these and other objects are achieved in practice will be more apparent when reference is made to the illustrated embodiment shown in detail in the accompanying drawings, in which like reference numbers indicate corresponding parts.

BRIEF DESCRIPTION OF THE DRAWINGS

FIG. 1 is a perspective view of a container lid made according to the present invention and shown attached to a portion of a container which is shown in fragmentary form;

FIG. 2 is a top plan view of a container lid made according to the present invention illustrating the rim engaging skirt and one form of access strip;

FIG. 2A is a fragmentary view of the container lid, showing the shape of the preferred form of opening for the latch pin;

FIG. 3 is a vertical sectional view of the container lid of FIG. 2, taken along lines 3—3 thereof;

FIG. 4 is a vertical sectional view similar to that of FIG. 3 but showing the lid or access flap in its opened and latched position; and FIG. 5 is an enlarged exploded vertical sectional view of the latch pin of a container lid made according to the present invention, and one form of tool used to form the latch pin;

DESCRIPTION OF THE PREFERRED EMBODIMENTS OF THE INVENTION

While the principles of the present invention may be utilized in different applications, the main presently known application for the inventive product is in the field of container lids used to cover containers made from paper, expanded polystyrene, or other plastic, or otherwise being adapted to be disposed of economically. The ordinary application is therefore for a round container having certain constructional features of a known type, although the principles of the invention may be applied to other products.

Referring now to the drawings in greater detail, FIG. 1 shows a container lid generally designated 10 and shown to embody the present invention; the lid 10 includes a center panel generally designated 12 and including a contoured top surface 14, a peripheral skirt generally designated 16 and shown to depend from the outer margin of the center panel 12. An access flap unit generally designated 18 is formed from a portion of the skirt 16 and from a part of the center panel 12.

The skirt 16 is shown to include means in the form of an inwardly directed bead 20 for engaging the outer margin 22 (FIG. 3) of an associated container 24. In addition, FIG. 1 shows a small, latch-receiving opening 26 formed in the center panel 12. In this case, the opening 26 also serves as a vent in addition to comprising the receiving means for the access flap latch pin 28 to be described in detail later. FIG. 2A is enlarged to show that the opening 26 preferably includes a flat or chordwise section as well as a circular section.

Referring again in particular to FIGS. 1–3, the upper surface generally designated 30 of the center panel 12 is a contoured element having the basic purpose of covering the open top of the associated container 24. The inner surface 32 (FIG. 3, 4) of the center panel 12 normally rests upon the upper surface 34 of the container rim 36.

Referring again to the drawings, it is shown that the contoured center panel 12 includes not only a planar section 38, but also a plurality of pockets 40 generally designated 40 formed therein. Each of the pockets includes substantially vertical walls 42 and an offset panel 44. In keeping with the invention concept, the generally vertically extending walls 42 can form an additional contact surface with the container 24. In this case, the walls 42 are circumferentially spaced apart from one another and are adapted to have their outer surfaces engage the inner surface 45 of the container rim 36. Accordingly, in the embodiment shown in the drawings, there are four sets of walls 42 that extend arcuately and are spaced apart from the skirt to provide a sealing action supplementing that provided by the skirt 16.

As shown in the drawings, stacking rings 46, 48 that also act as stiffeners or rib-like reinforcing elements extend upwardly from the center panel 12. As shown, these stacking rings may be spaced apart from each other rather than being continuous.

Referring now to another important feature of the invention, the access flap generally designated 18 is shown to be formed from portions of the skirt 16 and the center panel 12. In addition, as shown in FIGS. 1 and 2, for example, a finger tab 50 may form the lowermost element of the access flap 18. The flap 18 is defined in part by lines of weakness 52, 54 in the top panel 12, as well as lines of weakness 56, 58 in the skirt 16. Notches 60, 62 may be formed to provide stress concentration areas where the finger tab 50 meets the skirt 16 to facilitate initial tearing.

In accordance with the invention, a depressed or otherwise suitably contoured hinge line 64 is shown to connect the spaced apart ends 66, 68 of the lines of weakness. Accordingly, the preferred form of access flap is defined by the finger tab 50, the lines of weakness just discussed and the hinge line 64.

An additional important feature is the latch pin generally designated 28 in FIG. 1 and shown enlarged in FIG. 5. In the preferred form, the latch pin 28 is hollow and integrally formed from the material comprising the center panel by a heat and vacuum process ("thermoforming"). The latch pin 28 includes an enlarged head portion 68, and a wall 70 defining the shank of the pin 28. In one embodiment, a pair of ribs 72, 73 may be formed in a portion of the shank. The size, length, and the extent of the undercut on the pin is selected so that the pin will engage the vent hole with a desired degree of interference, i.e., one permitting snug retention but still providing for release for reclosure. The exact configuration of the pin is not crucial to the invention but the provision of a head which is slightly enlarged relative to the shank is preferred and it is possible to make such a product by a suitable use of the thermoforming process.

In the form of apparatus illustrated, the latch pin opening 26 also serves as the vent opening in the container lid, although the venting function per se may be eliminated or might be provided by another means. Ordinarily, a vent opening is provided to release carbonation or heated vapor and to prevent "pop off", or undue drawing down of the lid, rendering its removal difficult. According to the present invention, the provision of a vent opening that also serves the additional purpose of accommodating a latch pin is considered desirable and advantageous. The opening 26 preferably includes a flat, chordwise surface 26*a* connecting the ends of a circular portion 26*b*.

Referring now to the lid of the invention, in use, after a beverage container 24 is filled, the lid 10 is secured thereover in the manner shown in FIG. 1. In this condition, the skirt portion, including the inwardly extending bead 20, will engage the associated surfaces of the liquid container 24 in a snug relation. As is known to those skilled in the art, the tightness of the fit desired is achieved by manufacturing the parts to clearances such that accidental or unintentional removal is avoided, but making the fit loose enough that undue deformation of the container rim 36 is avoided and intentional separation can be achieved.

Referring now to the use of the access flap, when it is desired to open the flap, the tab is grasped and an upward, and preferably slightly twisting, force is applied. Stress concentrations exist where the lines of weakness 56, 58 start, permitting fracture of the skirt. A continued upward lift permits the tear thus initiated to continue to propagate across the lines of weakness 52, 54 in the center panel 12 of the lid 10. The tearing normally continues readily until a pair of spaced apart points 66, 68 are reached. Here, the lines of weakness terminate and the hinge line 64 described above permits ready folding of the access flap to the position shown in FIG. 4. Here, simply pivoting the entire access flap about the axis of the hinge line 64 permits the head 68 of the latch pin 28 to enter the opening 26 provided in the center panel 12.

By reason of the resilient nature of the material, the head 68 of the pin 28 will snap into the opening and retain the access flap in the fully open position as illustrated in FIG. 4. The flat portion 26*a* of the opening 26 assists in retaining the latch pin 28 in the opening.

When the access flap is in the raised and latched position, assuming that the latched pin 28 and the opening 26 are appropriately dimensioned, the flap 18 will remain in its open position. However, the finger tab 50 remains accessible as shown in FIG. 4, and a slight lifting force applied thereto will dislodge the pin 28 from the opening 26 and permit the flap to be returned to a closed position to provide at least some reduction in spillage and to insure better thermal insulation for the contents. The access flap may be opened and closed any reasonable number of times and may be held open each time by cooperation between the latch pin and the latch pin receiving opening.

Referring now to the certain advantages of this construction, the prior art has provided container lids that include integral means in the lid for insuring that the access flap will remain open. However, most or all of these constructions have required registration of relatively large areas of the lid with each other. For example, in some cases it has been necessary to insert the tab entirely within a pocket or other depression. In such an instance, the finger tab is required to lie flush with the panel surface and this adversely affects the ability to return the latched-open access flap to the closed position.

Moreover, in such arrangements, the requirement of space has complicated the design of such products. In other words, the degree of opening provided may be limited because the depression or pocket serving to engage the skirt portion of the access flap is constrained by the size of the lid. Thus, where the access flap skirt is used as the engaging element, the engagement area normally would be required to lie quite close to the opposite portion of the lid skirt. According to the present invention, the vent hole can serve as the latch pin receiving opening and because the latch pin can be located anywhere on the access flap, the vent and latching opening can be located near the lid center without interfering with the provision of a relatively generoussized access flap.

Referring again to the drawings, other optional but preferred features of the invention are shown. For example, FIGS. 2 and 3 show that the lid 10 may include auxiliary rim-engaging means including a narrow additional pocket 74 formed in a portion of the access flap. This helps hold the flap closed after it has once been opened. As shown in FIG. 3, the wall 77 of the auxiliary pockets 74 can engage the container rim inner surface 45 for additional security.

Other described features, such as the notch to initiate tearing and the auxiliary finger tab are preferred, but not strictly necessary according to the invention.

The lines of weakness 56, 58 and 52, 54 may be achieved by cutting entirely through portions of the center panel and skirt respectively, leaving uncut portions between them. In another embodiment, such lines may be formed by embossing or debossing part of the cover, with or without diminishing the thickness of the panel in these areas. In other words, the application of a heated die, during or after the formation process can form contoured areas disposed to easy fracture. Some of these areas, if created as a result of stretching the plastic sheet, may comprise areas of reduced material thickness, thus enhancing the likelihood of fracture in the desired area.

Techniques such as those just described and others are known to those skilled in the art for outlining such areas of weakness. Likewise, the hinge line 64 is preferably made by a raised or depressed line formed during manufacture.

In the practice of the invention, a thin, economical thermoplastic sheet material is preferred for use. Such materials typically comprise a modified or unmodified styrene or other polymer, preferably having a thickness of about 0.008–0.012". While the exact material is not an essential part of the invention, advantageous results are believed achievable when such material comprises a polystyrene material for example.

Referring now to another matter, one method for forming the latch pin 28 of the invention is shown merely by way of illustration. In FIG. 5, there is shown a forming stake 76 having a slightly enlarged head portion 78 extending upwardly from a foraminous or vented surface 80 which, it will be understood, contains plural, extremely fine diameter holes permitting application of vacuum thereto. In the forming process, a sheet of the material from which the lid 10 is formed is suspended over the forming stake 76 and heated. As the sheet material engages the stake, the material remains fluent and tends to take the shape of the object over which it is urged by the application of vacuum. Initially, a relatively large bulge the size of the head is created, and as vacuum continues to be applied, while the plastic sheet material may wrinkle slightly, it continues to be drawn down over the stake 76. This imparts the shape shown in FIG. 5 to the latch pin 28, i.e., a shape including an enlarged head, a narrow shank and the webs 72, 74. Because of the inherent resiliency of the material, the lid may readily be removed from the stake 76 after formation and material hardening.

It will thus be seen that the present invention provides a container lid having a number of novel advantages and characteristics, including those referred to specifically herein and others which are inherent in the invention. A preferred form of container lid of the invention having been described in detail, by way of example, it is anticipated that the variations in the described form of construction may occur to those skilled in the art, and that such variations may be made without departing from the spirit of the invention or the scope of the appended claims.

I claim:

1. A container lid removably receivable over a rim portion of an associated container having an interior with said lid being made from a single sheet of stiff but resilient material, said container lid comprising, in combination, a center panel portion and a peripheral skirt portion depending from an outer margin of said center panel portion and terminating in a free skirt edge, said container lid having a small pin-latch opening extending through said center panel portion, said lid also including an access flap formed by portions of said center panel and said peripheral skirt with said access flap providing access to said interior of the container with which said container lid is associated, said peripheral skirt portion being dimensioned, constructed, and arranged so as to snugly engage at least portions of an outer, upper margin of said rim portion of said associated container so as to prevent unintentional removal of said lid from said container, said access flap being defined in part by spaced apart lines of weakness extending from the free skirt edge of said peripheral skirt through the remainder of said skirt portion and inwardly from an outer margin of said center panel portion toward the center thereof, said lines of weakness terminating at spaced apart points separated from each other by a hinge line about which said access flap is pivotable, said access flap thereby being movable between open and closed positions, said access flap further including a substantially hollow latching pin integrally formed from a portion of said sheet material comprising said access flap, said hollow pin being positioned on said flap between the outer margin of said center panel and said flap hinge line, said pin latch opening being spaced from said hinge line a distance substantially equal to the distance between said hinge line and said latching pin, whereby, when said access flap is pivoted about said hinge line to a fully opened position, said latching pin automatically registers with and is received and retained within said latch opening to releasably retain said access flap in said open position.

2. A container lid as defined in claim 1 wherein said center panel portion includes a generally planar portion and at least one depressed pocket formed therein, an outer margin of said pocket comprising a wall portion extending substantially vertically and generally parallel to the said skirt portion of said lid, whereby said rim of said container may be engaged by both said lid skirt and said pocket wall.

3. A container lid as defined in claim 2 wherein said lid includes plural depressed pockets, each having rim-engaging walls.

4. A container lid as defined in claim 1 wherein said access flap further includes a finger tab portion extending beyond the portion of said lid skirt from which said flap is formed.

5. A container lid as defined in claim 4 wherein said skirt includes notches disposed therein that extend from the free skirt edge portion of said skirt to the area wherein said lines of weakness commence, said notches thereby concentrating stresses created by lifting forces applied to said tab portion on said access panel.

6. A container lid as defined in claim 1 wherein said lid is made from a thermoplastic sheet material.

7. A container lid as defined in claim 1 wherein said latch pin is formed by application of vacuum to an underside of the sheet material from which said pin is formed.

* * * * *